United States Patent [19]

Grist et al.

[11] Patent Number: 4,640,491

[45] Date of Patent: Feb. 3, 1987

[54] WALER CORNER LOCK ASSEMBLY

[75] Inventors: Warren W. Grist; David L. Kelly, both of Sacramento, Calif.

[73] Assignee: The Burke Company, San Mateo, Calif.

[21] Appl. No.: 747,322

[22] Filed: Jun. 21, 1985

[51] Int. Cl.[4] ..... E04G 17/02

[52] U.S. Cl. ..... 249/219 W; 248/220.1; 249/194

[58] Field of Search ..... 249/219 W, 219 R, 194, 249/27; 248/220.1

[56] References Cited

U.S. PATENT DOCUMENTS

| | | | |
|---|---|---|---|
| Re. 14,807 | 2/1920 | McKay | 249/194 |
| D. 225,506 | 12/1972 | Priore | D8/72 |
| 1,367,438 | 2/1921 | Strausbaugh | 249/194 |
| 1,519,418 | 12/1924 | Peck | 249/194 |
| 2,313,880 | 3/1943 | Leggett, Sr. | 249/194 |
| 2,352,783 | 7/1944 | Geer | 249/219 W |
| 3,066,962 | 12/1962 | Koehler | 249/219 R |
| 3,070,337 | 12/1962 | Gates | 249/219 W |
| 3,491,981 | 1/1970 | Harbert | 249/219 W |
| 3,795,381 | 3/1974 | Argust | 249/194 |
| 4,552,885 | 9/1925 | Seat | 249/219 W |

FOREIGN PATENT DOCUMENTS

| | | | |
|---|---|---|---|
| 1809527 | 6/1970 | Fed. Rep. of Germany | 249/194 |
| 625024 | 9/1961 | Italy | 249/219 R |

*Primary Examiner*—Jay H. Woo
*Assistant Examiner*—James C. Housel
*Attorney, Agent, or Firm*—Limbach, Limbach & Sutton

[57] ABSTRACT

Form panel supporting walers (32, 34) are secured in crossed relationship by an assembly having inner and outer right angle-shaped members (10, 12) engageable with opposite sides of the walers, and clamp means to draw the members toward one another. The clamp means comprise a bar (18) fixed to one of the members (10) and extending slidably through the other of the members (12), and a wedge (24) extending through the bar (18) for engagement with said other member (12).

11 Claims, 6 Drawing Figures

WALER CORNER LOCK ASSEMBLY

BACKGROUND OF THE INVENTION

The present invention relates to a clamp assembly for securing walers in crossed relationship and, more particularly, is directed to such an assembly which includes members complementally engageable with the inner and outer surfaces of the walers. In its more specific aspects, the invention is concerned with such an assembly wherein one of the members may also serve to secure form panels supported by the walers in intersecting relationship.

Prior art corner ties or clamps have typically employed fixed corner members which maintain walers in crossed relationship, or external clamps which draw walers toward corner-forming panels. Devices of the former type may be seen in U.S. Pat. Nos. 2,352,783 and 3,066,962. Devices of the latter type may be seen in U.S. Pat. No. 3,795,381. With either type of device the crossed walers are not engaged both internally and externally through means of a clamping assembly which serves to draw them into fixed locked relationship relative to one another.

SUMMARY OF THE INVENTION

The principal elements of the assembly of the invention comprises inner and outer members complementally engageable with the inner and outer surfaces of a pair of crossed walers, and a clamp to selectively secure the members against separation. In the preferred embodiment, the members are of an angle-shaped configuration corresponding to the shape of the corner to be formed by the form panels supported by the walers.

A principal object of the invention is to provide a corner lock assembly having elements which engage walers internally and externally to secure the walers in crossed relationship.

Another object of the invention is to provide such an assembly with means to selectively draw the waler engaging elements toward one another.

Another object of the invention is to provide such an assembly which is not dependent upon other elements engaged with the walers, such as form panels, to maintain the walers in crossed relationship.

Yet another object of the invention is to provide such an assembly which is engageable with form panels disposed internally of the walers to hold the panels in intersecting relationship.

A further object of the invention is to provide such an assembly which does not require that the walers secured thereby be cut.

Still another object of the invention is to provide such an assembly which may be used with single or double waler systems.

Yet another object of the invention is to provide such an assembly which is easy to install and strip, and may be locked and unlocked quickly.

The foregoing and other objects will become more apparent when viewed in light of the accompanying drawings and following detailed description.

DESCRIPTION OF THE PREFERRED EMBODIMENT

Figure 1:
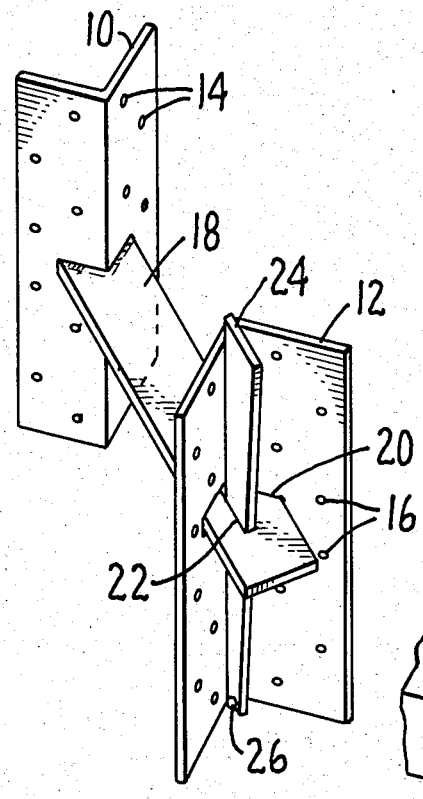
FIG. 1 is a perspective view of the assembly.
Figure 6:
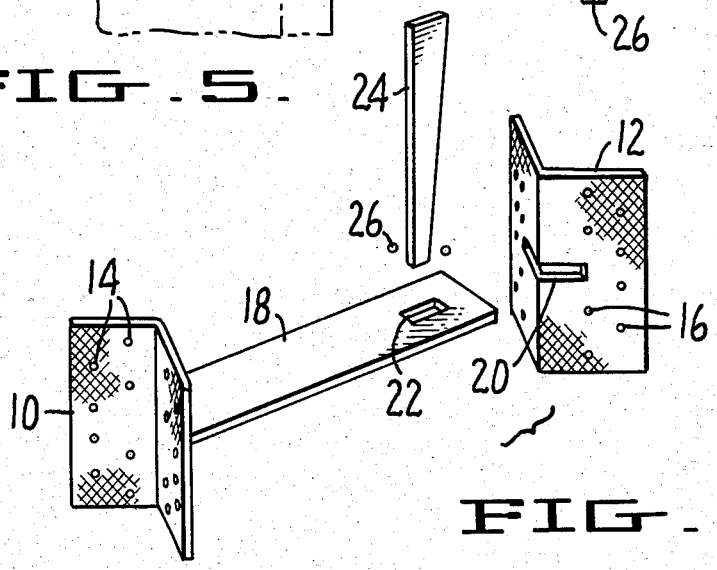
FIG. 6 is an exploded perspective view of the assembly.

Referring now to FIGS. 1 and 6, the first or inner member of the assembly is designated by the numeral 10 and the second or outer member of the assembly is designated by the numeral 12. These members are each of right angle-shaped configuration and fabricated of a rigid material, such as steel plate. Throughbores 14 are provided in the member 10 for the passage of nails therethrough in order that this member may be secured to form panels. Throughbores 16 are provided in the member 12 in order that nails may be passed therethrough to secure this member to wooden walers.

A bar 18 is welded to the member 10 in normal relationship thereto and extends slidably through a slot 20 formed in the member 12. The outer end of the bar extending through the member 12 is provided with a slot 22 for the receipt of a wedge 24. In the assembled condition shown in FIG. 1, the wedge 24 is received in the slot 22 to secure parts of the assembly against separation. The upper end of the wedge is sufficiently large so that it cannot pass fully through the slot 22. The small bead 26 is provided at the bottom of the wedge to prevent the wedge from being fully removed from the slot 22. The bead may take any suitable form, such as weld, pop-rivet, peened over end, or pin.

Forcing of the wedge 24 into the slot 22 serves to move the member 12 toward the member 10. When the members 10 and 12 are engaged with walers, this functions to draw the members into complemental engagement with the surfaces of the walers and, ultimately, lock the members in such engagement.

Figure 2:
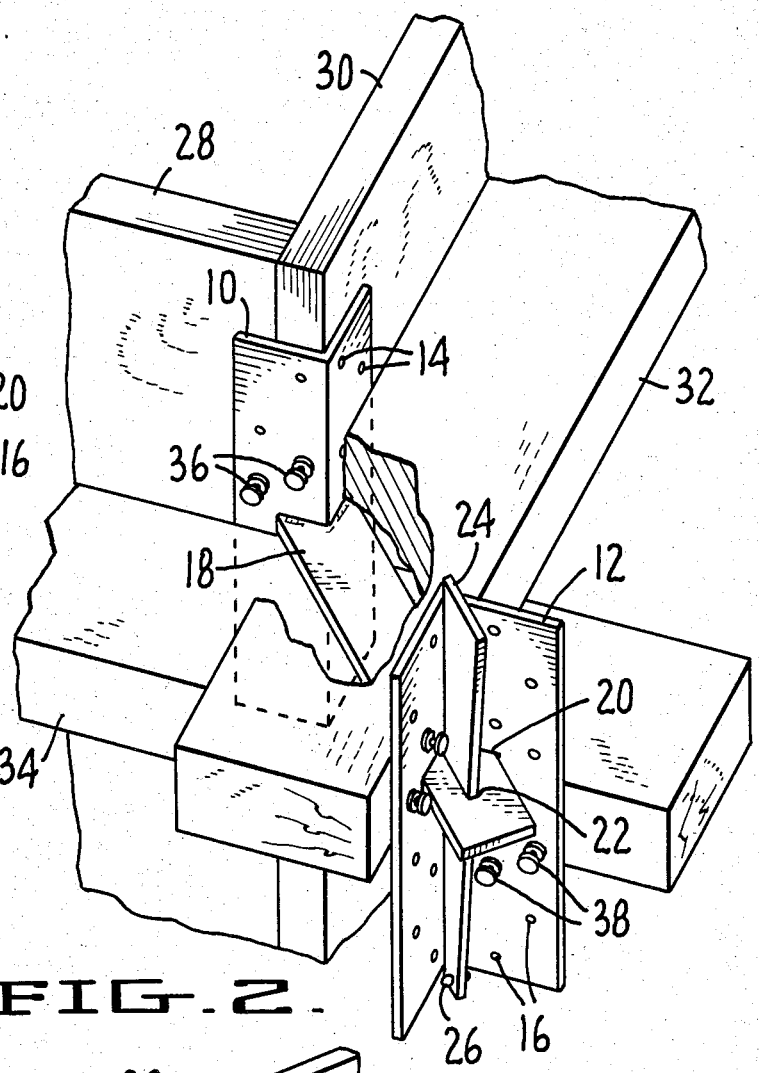
FIG. 2 is a perspective view, with parts thereof broken away, illustrating a corner form with a single pair of walers secured in place through means of the assembly.

FIG. 2 shows the assembly in a condition securing a pair of form panels 28 and 30 in intersecting relationship, with a single pair of walers 32 and 34 secured in supporting relationship to the panels. As there seen, the bar 18 extends between the walers. Nails 36 secure the member 10 to the form panels so as to maintain the panels in tight intersecting relationship to one another. Nails 38 secure the member 12 to the walers 32 and 34. The wedge 24 is shown in the condition where it draws the members 10 and 12 into secure engagement with the walers.

Figure 3:
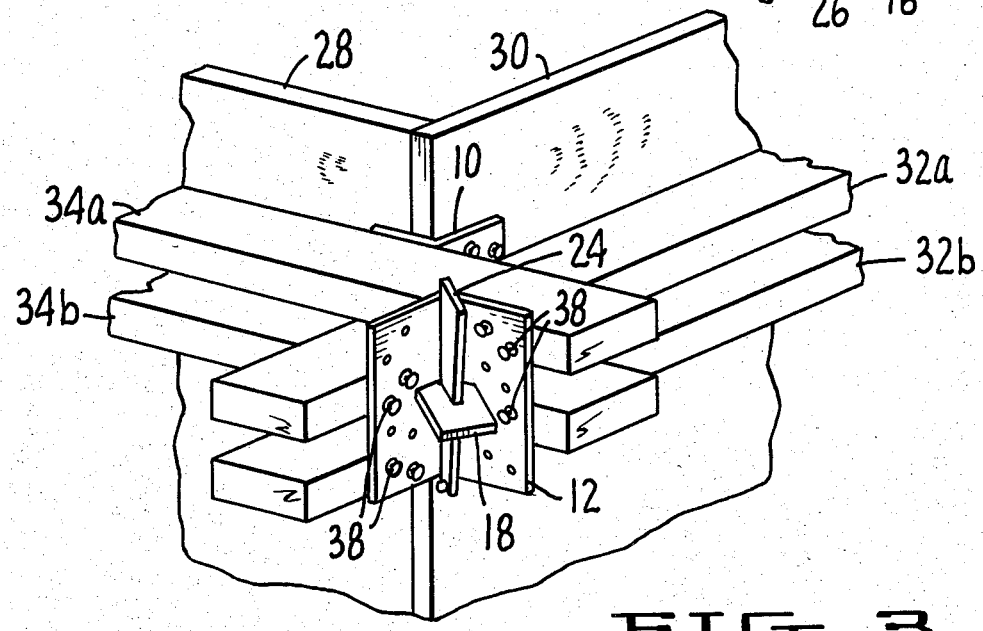
FIG. 3 is a perspective view, with parts thereof broken away, illustrating a corner form with a double pair of walers secured in place through the assembly.

The arrangement shown in FIG. 3 corresponds to that of FIG. 2, except that a double pair of walers is used in place of the single pair. The double walers are designated by the numerals 32*a*, 32*b*, 34*a*, and 34*b*. From FIG. 3, it will be seen that the members 10 and 12 are of sufficient height to span the pair of walers and that the throughbores 16 in the member 12 provide for nailing of the member to all of the walers.

Figure 4:
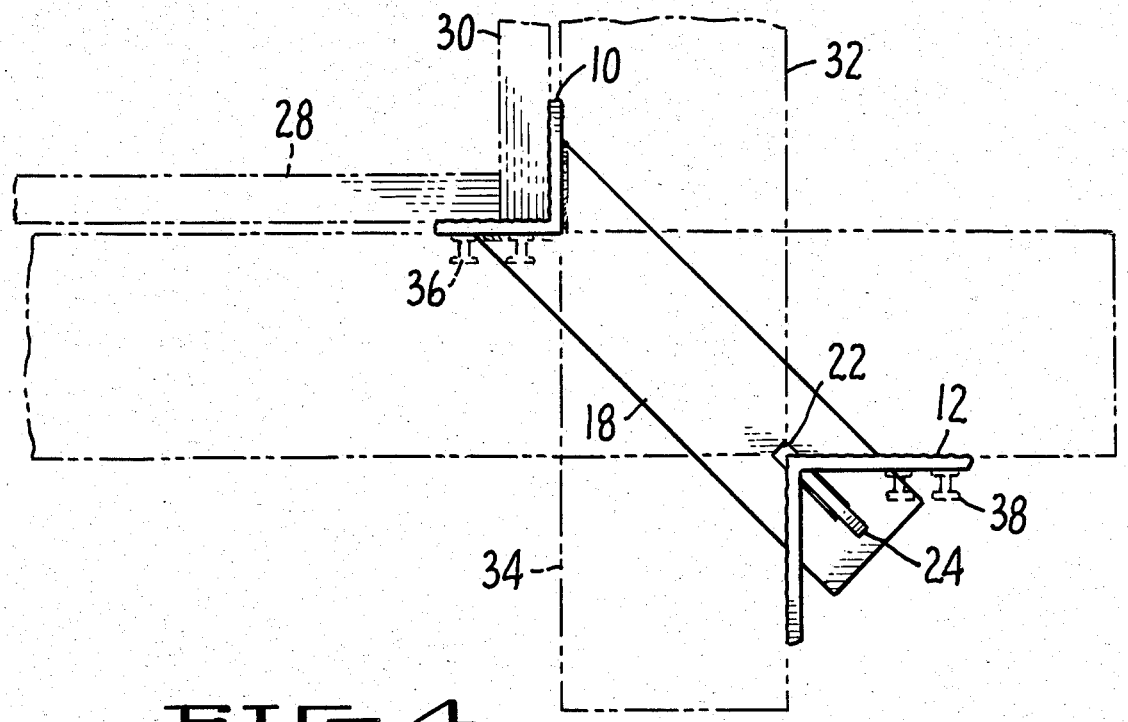
FIG. 4 is a top plan view illustrating the assembly applied to secure a pair of form panels in intersecting relationship, with walers in supporting engagement with the panels.
Figure 5:
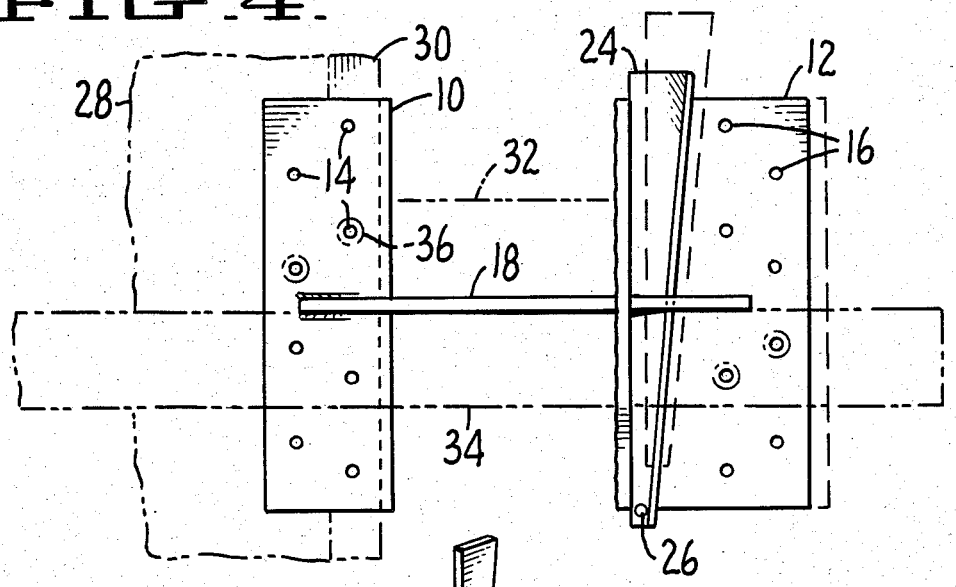
FIG. 5 is a side elevational view illustrating the assembly in the condition shown in FIG. 4.

FIGS. 4 and 5 illustrate the assembly in use with a single pair of walers corresponding to that shown in FIG. 2. From FIG. 4, it will be seen that the slot 22 is so positioned and of such a length that it extends to the inside of the member 12 when the member is drawn into secure engagement with the walers. This assures snug engagement of the members 10 and 12 with the walers.

In the preferred embodiment, the internal surfaces of the members 10 and 12 are serrated. This may be seen from FIGS. 4 and 6. The serrations enhance the frictional engagement of the member 10 with the form panels and the member 12 with the walers.

CONCLUSION

While the invention has been described with reference to applications where the inner member 10 engages intersecting form panels, the invention may also be used in applications where the form panels are spaced inwardly from the inner member 10. Such applications, for example, may employ studs on the inside of the walers which function to space the form panels from the walers. Accordingly, it should be appreciated that the invention is not intended to be limited to the specifics of the illustrated embodiments, but rather is defined by the accompanying claims.

We claim:

1. An assembly for securing a pair of walers in crossed relationship, said assembly comprising: a first member having converging outwardly facing surfaces complementally engageable with the crossed walers to one side thereof, said outwardly facing surfaces of said first member defining a first angle therebetween; a bar secured to said first member and extending outwardly from the outwardly facing surfaces thereof; a second member received on said bar and having inwardly facing converging surfaces defining a second angle therebetween, said inwardly facing surfaces of the second member being complementally engageable with the crossed walers to the side thereof opposite said one side and said second member being movable relative to said bar to bring the outwardly facing surfaces of the first and second members into simultaneous engagement with opposite sides of the crossed walers, said first and second angles being essentially equal; and means to secure said second member to said bar to maintain the first and second members in such engagement.

2. An assembly according to claim 1 wherein said first and second members are of rigid angle-shaped configuration.

3. An assembly according to claim 1 or 2 wherein the bar is fixed relative to the first member and extends through a slot provided therefor in the second member.

4. An assembly according to claim 3 wherein said securing means comprise a slot formed in the bar and a wedge extendable through the slot for engagement with the second member.

5. An assembly according to claim 2, further comprising through bores formed in said first and second members to provide for the passage of securing nails therethrough.

6. An assembly for securing a pair of walers in crossed relationship to one another, said assembly comprising: a first member of right angle-shaped configuration having converging outwardly facing external surfaces complementally engageable with the crossed walers to one side thereof, said external surfaces defining a first angle therebetween; a flat bar fixedly secured to and extending from the external surfaces of the first member for passage between the walers; a second right angle-shaped member slidably received on the bar, said second member having converging inwardly facing surfaces defining a second angle therebetween, and inwardly facing surfaces of the second member being complementally engageable with the crossed walers to the side thereof opposite said one side, said first and second angles being essentially equal; and means to force said second member toward the first member.

7. An assembly according to claim 6 wherein said force means comprise a slot formed in the bar and a wedge extendable through the slot for engagement with the second member.

8. An assembly according to claim 6, further comprising through bores formed in said first and second members to provide for the passage of securing nails therethrough.

9. An assembly according to claim 6 wherein said first member has internal surfaces for complemental engagement with the external surfaces of intersecting form panels supported by walers secured to one another by the assembly.

10. An assembly for securing a pair of walers in crossed relationship to one another, said assembly comprising: a first angle-shaped member having converging outwardly facing surfaces complementally engageable with the crossed walers to one side thereof, said outwardly facing surfaces defining a first angle therebetween; a second angle-shaped member having inwardly facing converging surfaces defining a second angle therebetween, said inwardly facing surfaces of the second member being complementally engageable with the crossed walers to the side thereof opposite said one side, said first and second angles being essentially equal; and means to selectively draw the first and second members toward one another.

11. An assembly according to claim 10 wherein said draw means comprise: a bar fixed to one of the members and extending slidably through the other of the members; and a wedge carried by the bar for engagement with said other member.

* * * * *